US009937371B2

(12) United States Patent
Werner

(10) Patent No.: US 9,937,371 B2
(45) Date of Patent: Apr. 10, 2018

(54) POLE VAULT SWING-UP RACK

(71) Applicant: Timothy R. Werner, Woodland Hills, CA (US)

(72) Inventor: Timothy R. Werner, Woodland Hills, CA (US)

( * ) Notice: Subject to any disclaimer, the term of this patent is extended or adjusted under 35 U.S.C. 154(b) by 0 days.

(21) Appl. No.: 15/802,888

(22) Filed: Nov. 3, 2017

(65) Prior Publication Data

US 2018/0064980 A1 Mar. 8, 2018

Related U.S. Application Data

(63) Continuation of application No. 15/130,809, filed on Apr. 15, 2016, now Pat. No. 9,839,804.

(51) Int. Cl.
*A63B 1/00* (2006.01)
*A63B 17/04* (2006.01)
(Continued)

(52) U.S. Cl.
CPC ..... *A63B 5/16* (2013.01); *A63B 17/04* (2013.01); *A63B 21/00047* (2013.01);
(Continued)

(58) Field of Classification Search
CPC .... A63B 1/00; A63B 5/00; A63B 5/02; A63B 5/04; A63B 5/06; A63B 5/16; A63B 7/00; A63B 7/02; A63B 9/00; A63B 17/00; A63B 17/02; A63B 17/04; A63B 21/0004; A63B 21/00047; A63B 21/0005; A63B 21/00054; A63B 21/00058; A63B 21/00069; A63B 21/00072; A63B 21/00076; A63B 21/00178; A63B 21/00181; A63B 21/00185; A63B 21/002; A63B 21/0023;
(Continued)

(56) References Cited

U.S. PATENT DOCUMENTS 3,521,848 A * 7/1970 Ase ..... A63B 7/02 248/205.1
3,707,285 A * 12/1972 Martin ..... A63B 1/00 472/16
(Continued)

FOREIGN PATENT DOCUMENTS

CN 202289379 U 7/2012
CN 202315202 U 7/2012
(Continued)

*Primary Examiner* — Loan H Thanh
*Assistant Examiner* — Gary D Urbiel Goldner
(74) *Attorney, Agent, or Firm* — Kelly & Kelley, LLP

(57) ABSTRACT

A pole vault swing-up rack includes a frame body with upper hooks and a lower push bracket. The rack is designed to hang vertically from a horizontal bar—as a pull-up bar—by the hooks. An athlete hanging from the pull-up bar in an upright vertical position may kick his/her legs and torso up to an inverted vertical position to simulate movement of a pole vault. The athlete's shoulders rest against vertical uprights of the rack to maintain the athlete's shoulders and body in front of a vertical plane as in a pole vault movement. A trainer can use the lower push bracket to assist the athlete in the kicking motion. The parts of the rack that come into contact with the athlete may be covered in foam padding and a rubber coating.

12 Claims, 3 Drawing Sheets

(51) Int. Cl.

| | |
|---|---|
| ***A63B 21/00*** | (2006.01) |
| ***A63B 21/068*** | (2006.01) |
| ***A63B 21/28*** | (2006.01) |
| ***A63B 23/02*** | (2006.01) |
| ***A63B 23/12*** | (2006.01) |
| ***A63B 5/16*** | (2006.01) |
| ***A63B 69/00*** | (2006.01) |
| ***A63B 71/00*** | (2006.01) |
| ***A63B 71/02*** | (2006.01) |

(52) U.S. Cl.

CPC ..... *A63B 21/068* (2013.01); *A63B 21/4035* (2015.10); *A63B 23/0216* (2013.01); *A63B 23/1218* (2013.01); *A63B 69/0057* (2013.01); *A63B 1/00* (2013.01); *A63B 21/00181* (2013.01); *A63B 21/285* (2013.01); *A63B 71/023* (2013.01); *A63B 2071/0063* (2013.01); *A63B 2208/029* (2013.01); *A63B 2208/0285* (2013.01); *A63B 2244/085* (2013.01)

(58) Field of Classification Search

CPC ..... A63B 21/065; A63B 21/068; A63B 21/08; A63B 21/15; A63B 21/159; A63B 21/16; A63B 21/1618; A63B 21/1627; A63B 21/1636; A63B 21/1645; A63B 21/1654; A63B 21/1663; A63B 21/169; A63B 21/28; A63B 21/285; A63B 21/4005; A63B 21/4007; A63B 21/4009; A63B 211/4023; A63B 21/4025; A63B 21/4027; A63B 21/4029; A63B 21/4031; A63B 21/4033; A63B 21/4034; A63B 21/4035; A63B 21/4039; A63B 21/4043; A63B 21/4045; A63B 21/4047; A63B 21/4049; A63B 23/0205; A63B 23/0211; A63B 23/0216; A63B 23/0222; A63B 23/0233; A63B 23/0238; A63B 23/0244; A63B 23/035; A63B 23/03516; A63B 21/03575; A63B 23/04; A63B 23/0405; A63B 23/0482; A63B 23/0494; A63B 23/12; A63B 23/1209; A63B 23/1218; A63B 23/1245; A63B 23/1281; A63B 23/14; A63B 23/16; A63B 26/00; A63B 26/003; A63B 69/0057; A63B 69/0059; A63B 69/0064; A63B 71/0054; A63B 71/02; A63B 71/023; A63B 2071/0063; A63B 2071/0072; A63B 2071/0081; A63B 2071/026; A63B 2071/027; A63B 2208/0271; A63B 2208/0276; A63B 2208/028; A63B 2208/0285; A63B 2208/029; A63B 2244/085

USPC ..... 482/14–18, 23, 24, 33, 38–43, 142–144

See application file for complete search history.

(56) References Cited

U.S. PATENT DOCUMENTS

| | | | | |
|---|---|---|---|---|
| 4,017,070 | A | 4/1977 | Hilton | |
| 4,018,437 | A * | 4/1977 | LoPresti | A63B 1/00 248/161 |
| 4,458,894 | A * | 7/1984 | Dudley | A63B 1/00 482/40 |
| 4,515,152 | A * | 5/1985 | Teeter | A61H 1/0218 482/144 |
| 4,714,247 | A * | 12/1987 | Gerstung | A63B 23/1209 482/105 |
| 4,778,174 | A | 10/1988 | Tolsma | |
| 5,304,109 | A | 4/1994 | Shockley | |
| 5,540,643 | A * | 7/1996 | Fontaine | A61H 1/0229 482/143 |
| 5,551,936 | A | 9/1996 | Parisi et al. | |
| 5,876,314 | A * | 3/1999 | Sugimura | A63B 19/04 482/144 |
| 6,162,148 | A * | 12/2000 | Lockwood | A63B 69/00 482/14 |
| 6,203,473 | B1 * | 3/2001 | Atwood | A63B 21/00047 482/142 |
| 6,905,447 | B1 * | 6/2005 | Walter | A61H 1/0292 482/121 |
| 6,932,744 | B1 | 8/2005 | Ford et al. | |
| 7,566,292 | B1 * | 7/2009 | Hauser | A63B 1/00 16/422 |
| 8,172,737 | B1 * | 5/2012 | Nihlman | A63B 23/03575 482/100 |
| 9,114,273 | B2 * | 8/2015 | Kehoe | A63B 21/00047 |
| 2004/0116259 | A1 * | 6/2004 | Rosiles | A63B 5/16 482/121 |
| 2006/0052222 | A1 * | 3/2006 | Cardenas | A61H 1/0229 482/96 |
| 2010/0081551 | A1 * | 4/2010 | Harley | A63B 21/00047 482/142 |
| 2012/0258842 | A1 * | 10/2012 | Davidow | A63B 21/00054 482/91 |
| 2013/0225373 | A1 * | 8/2013 | Poat | A63B 21/1636 482/40 |
| 2013/0244836 | A1 * | 9/2013 | Maughan | A63B 21/1645 482/40 |
| 2013/0303348 | A1 * | 11/2013 | Cardin | A63B 21/0724 482/139 |
| 2014/0087928 | A1 * | 3/2014 | Luedeka | A63B 21/4023 482/130 |
| 2014/0302968 | A1 * | 10/2014 | Velikin | A63B 1/00 482/40 |
| 2015/0151159 | A1 * | 6/2015 | Davidow | A63B 23/025 482/91 |
| 2015/0196828 | A1 * | 7/2015 | Ogle | A63B 71/0619 473/422 |

FOREIGN PATENT DOCUMENTS

| | | |
|---|---|---|
| CN | 204563415 U | 8/2016 |
| DE | 3931319 A1 | 3/1991 |

* cited by examiner

POLE VAULT SWING-UP RACK

RELATED APPLICATION

This is a continuation of co-pending U.S. application Ser. No. 15/130,809, filed Apr. 15, 2016.

BACKGROUND OF THE INVENTION

The present invention is directed to an athletic training apparatus, specifically a pole vault swing-up rack. The swing-up rack helps train athletes in the mechanics of raising one's body vertically during a pole vault.

Prior art athletic training devices for the pole vault typically try to simulate the act of actually pushing one's body up while holding onto the pole. Such devices suffer from the disadvantage of involving multiple movements and positions in training, i.e., pushing, balancing, lifting, etc., while the athlete must also maintain his/her shoulders forward of the vertical line of the hands as would be in an actual pole vault action. Such multiple movement training more closely simulates the total movement of a pole vault. However, the inventor has found that breaking the mechanics of the pole vault action down into simpler movements improves training efficiency and overall results.

Accordingly, there is a need for a pole vault training apparatus that simplifies the training mechanics and improves efficiency and results. The present invention fulfills these needs and provides other related advantages.

SUMMARY OF THE INVENTION

The present invention is directed to a pole vault swing-up rack. The swing-up rack includes a generally rectangular frame body having a long dimension with a pair of vertical uprights oriented in and co-extensive with the long dimension. The frame body also has an upper crossbar and a lower cross-bar, both oriented perpendicular to the long dimension. A pair of hooks is attached to the frame body proximate to the upper crossbar. The pair of hooks preferably extend from a back side of the frame body. A push bracket is attached to the frame body proximate to the lower crossbar, with that push bracket extending from the back side of the frame body.

The push bracket is preferably oriented generally perpendicular to the frame body and may further include angle braces attaching the push bracket to the frame body at a point a fixed distance above the lower crossbar. The pair of hooks are each preferably configured to fit over a horizontal bar such that the pole vault swing-up rack hangs vertically downward from the horizontal bar.

The swing-up rack may also include a pair of foam pads, one encircling each of the pair of vertical uprights. The pair of foam pads preferably extends from proximate to the lower crossbar to at least half of the long dimension. The pair of foam pads are each preferably made from high-density, polyethylene foam for durability, but may be low-density. A rubber coating may surround each of the pair of foam pads. The rubber coating may be a vinyl rubber tape.

The rack may also include a lower foam pad on the lower crossbar, which lower foam pad is also polyethylene foam, either high-density or low-density. The lower foam pad is also preferably surrounded by a rubber coating such as vinyl rubber tape. Similarly, an upper foam pad may be included on the upper crossbar—also made from polyethylene foam, either high-density or low-density. The upper foam pad preferably includes a horizontal bar cut-out proximate to the pair of hooks on the back side of the frame body. The upper foam pad may also include a rubber coating, such as vinyl rubber tape.

A process for training an athlete in a pole vault movement using the pole vault swing-up rack described above begins with hanging the swing-up rack on an upper horizontal bar by the pair of hooks. The swing-up rack preferably hangs from the upper horizontal bar in a generally vertical orientation. The athlete is then positioned on a front side of the swing-up rack and the upper horizontal bar. The athlete grips the upper horizontal bar using his/her hands, one hand on each side the swing-up rack. The athlete then places his/her shoulders against the pair of vertical uprights while hanging from the upper horizontal bar straight-armed in an upright vertical position with his/her legs and torso adjacent to the lower crossbar. The athlete then kicks his/her legs and torso upward and away from the lower crossbar such that the athlete moves from the upright vertical position to an inverted vertical position with the athlete's legs and torso adjacent to the upper crossbar.

The athlete may then lower his/her legs and torso downward and away from the upper crossbar so as to move from the inverted vertical position to the upright vertical position with the athlete's legs and torso adjacent to the lower crossbar. The kicking and repeating steps can be repeated as many times as necessary to train the athlete in the pole vault movement. This resembles repetitions as are performed in any number of physical training exercises. The lower push bracket may be secured against a lower horizontal bar to assist the athlete in performing these steps on his/her own.

Alternatively, a trainer or coach may push the lower push bracket simultaneously with the athlete performing the kicking step. The pushing action causes the swing-up rack to move from the generally vertical orientation toward an approximately horizontal position. The simultaneous kicking and pushing action allows the trainer or coach to assist the athlete in performing the transition from upright vertical orientation to inverted vertical orientation. After the kicking step, the swing-up rack is returned to the generally vertical orientation.

When gripping the upper horizontal bar, the athlete may use an opposite hand grip meaning that one hand is facing the front side of the swing-up rack and the other hand is facing the back side of the swing-up rack.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
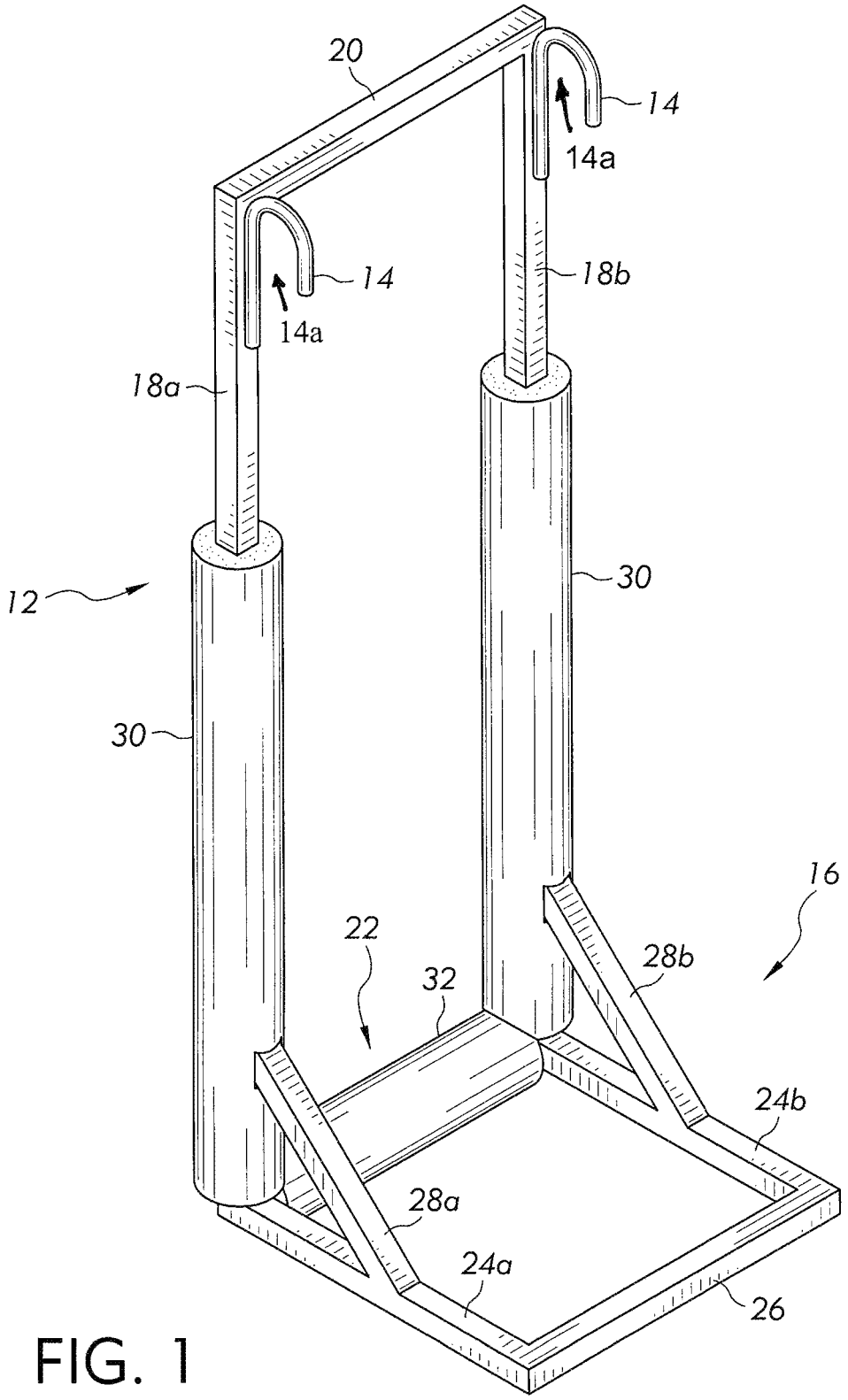
FIG. 1 is a rear perspective view of the pole vault swing-up rack of the present invention.

In the following detailed description, the pole vault swing-up rack of the present invention is generally referred to by reference numeral 10 in FIGS. 1-5. The main components of the swing-up rack 10 and the structural relationship of the same are most clearly shown in FIGS. 1 and 4. A complete perspective view of the rack 10 is shown in FIG. 1, including as the main components the frame body 12, the upper hooks 14, and the lower push bracket 16.

The frame body 12 has a generally rectangular shape with extended vertical uprights 18*a*, 18*b*, an upper crossbar 20, and a lower crossbar 22. The uprights, 18*a*, 18*b*, upper crossbar 20 and lower crossbar 22 are made from steel or other material of similar strength such that when joined together form a rigid, inflexible shape. These components preferably have a square cross-section, but may also be round or any other polygon shape provided it still has the requisite rigidity and inflexibility to support the weight of a human body as described below.

Figure 2:
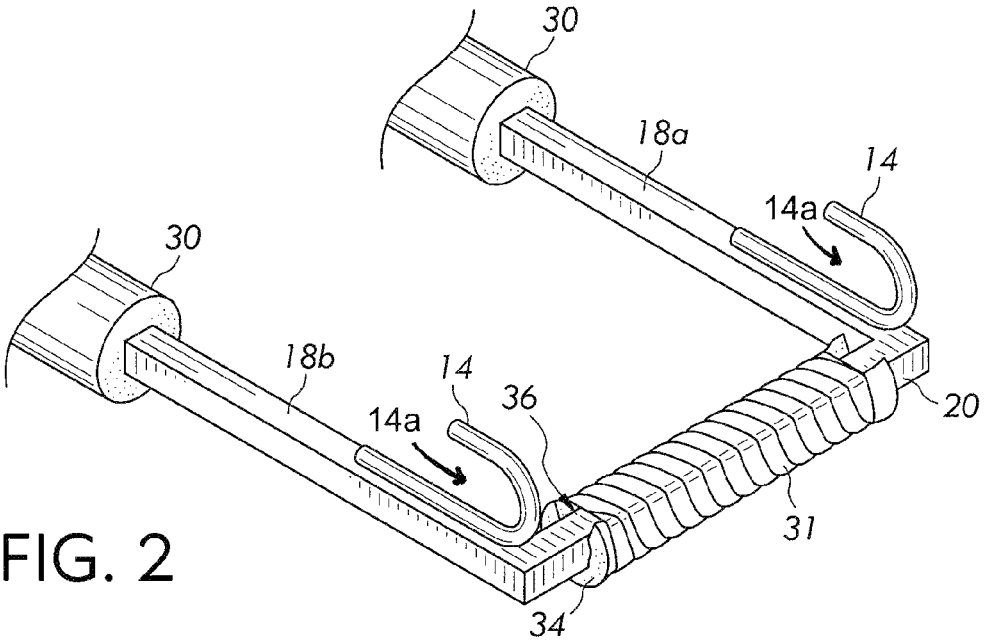
FIG. 2 is a close-up perspective view of the upper end of the pole vault swing-up rack of the present invention.

As shown in close-up view in FIG. 2, the upper hooks 14 are preferably attached to a back side of the frame body 12 near the top of each upright 18*a*, 18*b* and having openings 14*a* oriented toward the lower crossbar 22. The hooks 14 are preferably permanently attached to, as by welding, or formed integrally with upper ends of the uprights 18*a*, 18*b*, proximate to the upper crossbar 20. Alternatively, the hooks 14 may be permanently attached to, as by welding, or formed integrally with the upper crossbar 20 itself. The hooks 14 are also preferably made from steel or other material of similar strength so as to be sufficient to support the weight of a human body as described below.

Figure 3:
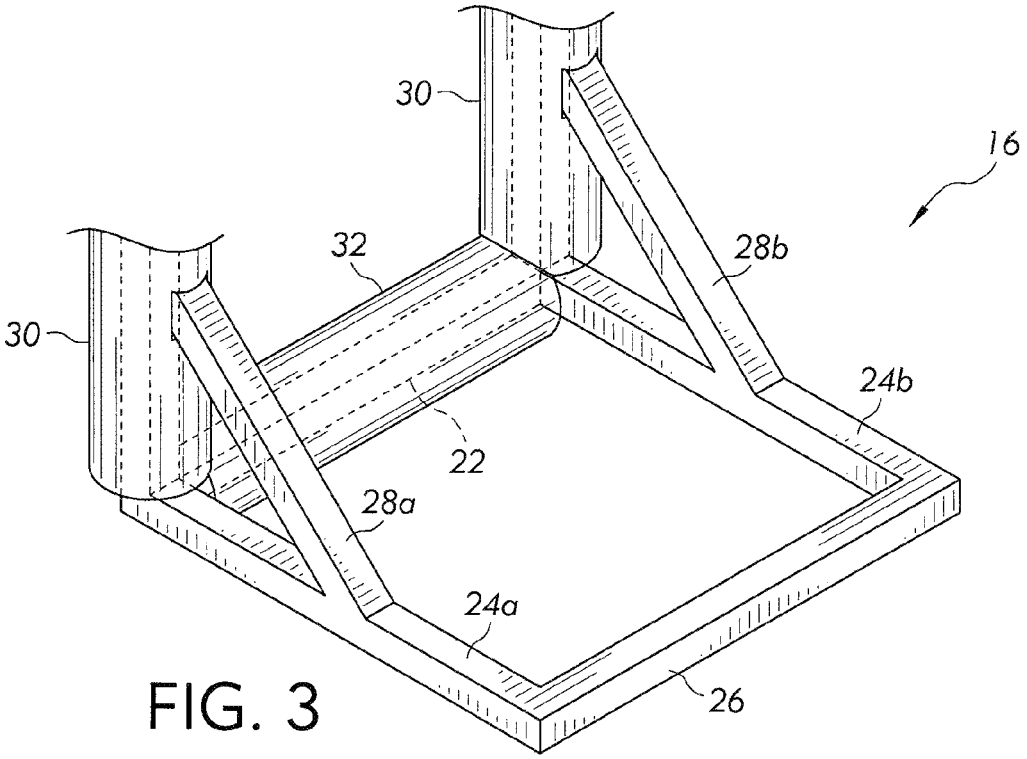
FIG. 3 is a close-up perspective view of the lower end of the pole vault swing-up rack of the present invention.

As shown in close-up view in FIG. 3, the lower push bracket 16 is preferably attached to the frame body 12 near the bottom of each upright 18*a*, 18*b*, e.g., the end of the uprights 18*a*, 18*b* opposite from the hooks 14. The push bracket 16 comprises two extending arms 24*a*, 24*b* that are each attached at a first end to the frame body 12. The first end of each extending arm 24*a*, 24*b* is preferably attached, as by welding, or integrally formed with each upright 18*a*, 18*b* proximate or adjacent to the lower crossbar 22. Alternative, the first end of each extending arm 24*a*, 24*b* may be attached, as by welding, or integrally formed with the lower crossbar 22 itself.

A pushing crossbar 26 spans the distance between and is attached to an opposite second end of each extending arm 24*a*, 24*b*. The extending arms 24*a*, 24*b* and the pushing crossbar 26 are preferably permanently attached, as by welding, or integrally form with each other. A pair of angle braces 28*a*, 28*b* may support the joint between the frame body 12 and the extending arms 24*a*, 24*b* as shown. All of the components of the lower push bracket 16, including the extending arms 24*a*, 24*b*, the pushing crossbar 26 and the angle brace 28 are preferably made from steel or other material of similar strength so as to be sufficient to support the weight of a human body as described below.

Each of the vertical uprights 18*a*, 18*b* are preferably surrounded by or enclosed in a padding 30 sufficient to provide comfort for a user of the rack 10 when a part of a user's body, i.e., shoulder, comes into contact with the same as described below. The padding 30 preferably comprises high-density polyethylene foam or similar material to provide comfort and durability over repeated use. The padding 30 may also be surrounded by a rubber coating 31 (see FIG. 2), such as vinyl or other similar rubber tape, to provide added protection and durability for the padding. In addition, the lower crossbar 20 may include lower padding 32 having similar characteristics and construction as padding 30. The lower padding 32 is designed to protect the backs of the legs of a user as described below. Furthermore, the upper crossbar 20 may include upper padding 34 also having similar characteristics and construction as padding 30. The upper padding 34 is designed to protect the shins, knees, and thighs of a user as described below. Although the rubber coating 31 is only illustrated around a portion the upper pad 34 in FIG. 2, the rubber coating 31 may be included around each pad 30, 32, 34, as needed, and is intended to cover as much of the pad as is necessary to protect and retain the pad.

Figure 5:
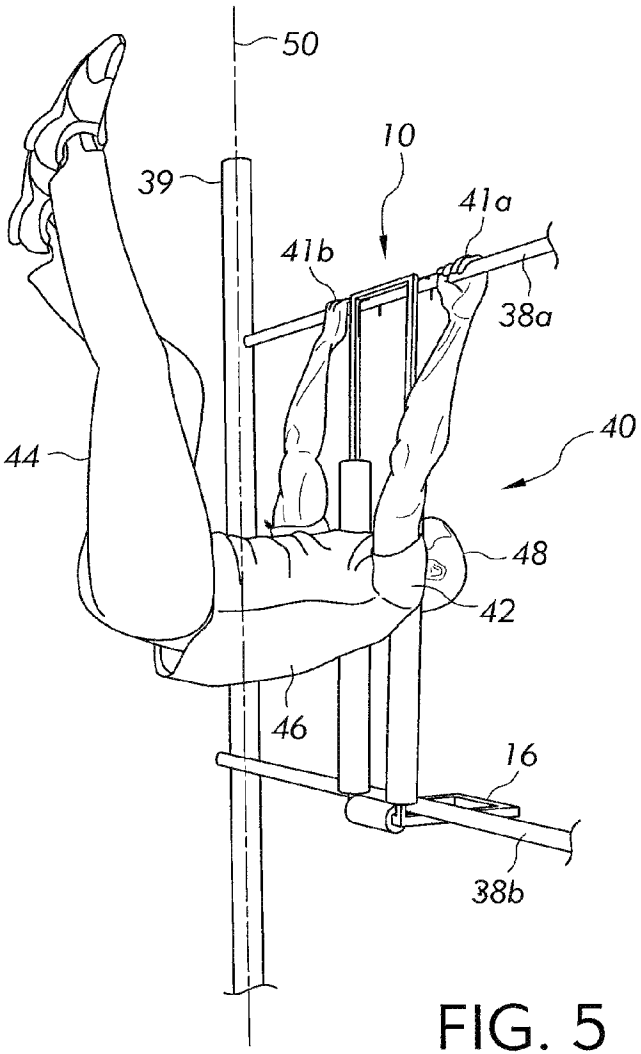
FIG. 5 is an environmental view of a person using the pole vault swing-up rack of the present invention.
Figure 4:
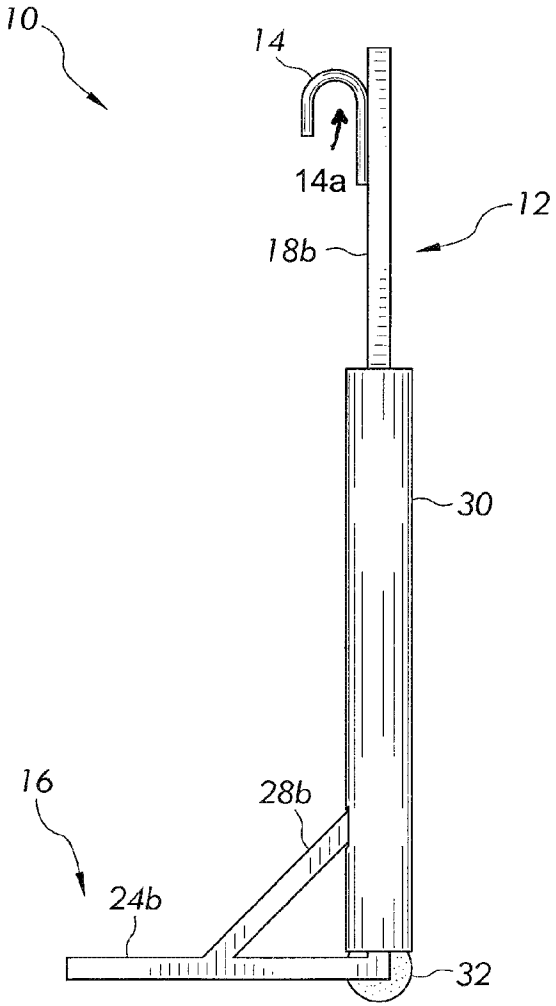
FIG. 4 is a side view of the pole vault swing-up rack of the present invention.

As shown in environmental view in FIG. 5, the swing-up rack 10 is designed to hang from an existing upper horizontal bar 38*a* by the hooks 14. The openings 14*a* of the hooks 14 should be configured to accommodate different sizes of horizontal bars 38*a*. Such horizontal bars 38*a* may be pull-up bars, swing-set bars, or other similar structural bars as might be found in an exercise setting. The upper padding 34 preferably includes a cut-out 36 on the same side of the frame body 12 as the hooks 14. This cut-out 36 is designed to accommodate the upper horizontal bar 38 such that the padding 34 does not interfere with the hooks 14 fully engaging the horizontal bar 38*a*.

For individual use without a trainer, the lower end of the rack 10 may rest against a lower horizontal bar 38*b*. The lower horizontal bar 38*b* may be fixed in a vertical plane with the upper horizontal bar 38*a*. Alternatively, the lower horizontal bar 38*b* may consist of a removable dowel or similar bar that rests against the frame body 12 proximate to the lower push bracket 16, as by passing through the opening between the frame body 12 and the angle braces 28*a*, 28*b*. In the case of a removable dowel or bar, the lower horizontal bar 38*b* preferably rests against the same vertical supports 39 that support the upper horizontal bar 38*a*.

The lower end of the rack 10 may also hang free without a lower horizontal bar 38*b*. In this case, the rack 10 may be used individually without a trainer where the upper horizontal bar 38*a* is a configured as a pull-up bar spaced a fixed distance from a vertical wall. In this base, the lower push bracket 16 is preferably configured to rest against the wall beneath the upper horizontal bar 38*a* so as to maintain the rack 10 in a generally vertical orientation. The rack 10 may also be used individually with a trainer with the lower end of the rack 10 hanging free. In this instance, the trainer would grip the lower push bracket 16 and push the rack 10 through a range of pivoting motion around the upper horizontal bar 38*a* as described below.

An individual person 40 using the rack 10 preferably positions themselves in front of the rack 10 and horizontal bar 38 in an upright vertical position. The person preferably grips the horizontal bar 28 using an opposite grip, e.g., one hand 41*a* facing the front side and the other hand 41 b facing the back side as shown, similar to how a pole is gripped in a pole vault. However, the person 40 may grip the bar 38*a* in any comfortable manner. The person 40 rests his/her shoulders 42 against the vertical uprights 18*a*, 18*b* with their arms at full extension from the upper horizontal bar 38*a*. In an exercise movement, the person 40 swings their legs 44 and torso 46 upwards to an inverted vertical position, e.g., upside down, as in a pole vault action. The person's head 48 moves in the space between the vertical uprights 18*a*, 18*b* during this exercise movement.

The rack 10 is designed to hold the shoulders 42 of person 40 in front of a vertical line 50 passing through the horizontal bar 38*a*, in line with the hands, while the person 40 is moving from the upright vertical position to the inverted vertical position. FIG. 5 shows the vertical line 50 through the support 39, which is in the same plane are a vertical line passing through any part of the horizontal bar 38*a* and the hands. The exercise movement using the rack 10 is designed to strengthen the person's shoulder extension, e.g., movement of the arms from an overhead position to a position near the hips. A coach or trainer may hold the lower push bracket 16 stable while the person 40 performs the exercise movement, or the trainer can assist the person's inversion through the exercise movement by pushing the lower push bracket 16 to move the bottom of the rack 10 forward giving the person 40 momentum to complete the inversion exercise movement.

Use of the inventive rack 10 by a person creates movement and resistance that very closely mimics the actual movement involved in performing a pole vault. The rack 10 allows a person to focus on and correct mechanical flaws in the swing-up motion of the pole vault. It helps the coach or trainer isolate any flaws in the movement, correct the flaws, and quickly and efficiently practice the swing-up motion in a repetitive manner with the same body positions found in the pole vault. The rack 10 allows the coach or trainer to provide the person with additional momentum in the swing and/or decrease the angle at the start to make the movement easier. This type of training allows the person to retain muscle memory of the movement when performing an actual pole vault. The rack 10 helps avoid neck strain and holds the person's shoulders in front of the hand grip just as in an actual pole vault movement. The same repetitive movement cannot be achieved with as much speed or efficiency simply by hanging on a high bar or rope.

Although several embodiments have been described in detail for purposes of illustration, various modifications may be made without departing from the scope and spirit of the invention. Accordingly, the invention is not to be limited, except as by the appended claims.

What is claimed is:

1. A pole vault swing-up rack, comprising:

a generally rectangular frame body having a long dimension with a pair of vertical uprights oriented in and co-extensive with the long dimension, an upper crossbar substantially coplanar with the pair of vertical uprights and oriented perpendicular to the long dimension, and a lower crossbar oriented perpendicular to the long dimension;

a pair of hooks attached to and extending from a back side of the frame body proximate to the upper crossbar, wherein said pair of hooks are configured with an opening oriented toward the lower crossbar so as to hang the frame body from a horizontal bar; and a push bracket attached to the frame body proximate to the lower crossbar, wherein said push bracket extends from the back side of the frame body.

2. The pole vault swing-up rack of claim 1, wherein the push bracket is oriented generally perpendicular to the frame body and further comprises angle braces attaching the push bracket to the frame body at a point a fixed distance from the lower crossbar.

3. The pole vault swing-up rack of claim 1, wherein the pair of hooks are configured to fit over the horizontal bar such that the pole vault swing-up rack hangs vertically downward from the horizontal bar.

4. The pole vault swing-up rack of claim 1, further comprising a pair of foam pads, one encircling each of the pair of vertical uprights, the pair of foam pads extending from proximate to the lower crossbar to at least half of the long dimension.

5. The pole vault swing-up rack of claim 4, wherein the pair of foam pads comprise polyethylene foam.

6. The pole vault swing-up rack of claim 4, further comprising a rubber coating surrounding each of the pair of foam pads.

7. The pole vault swing-up rack of claim 6, wherein the rubber coating comprises vinyl rubber tape.

8. The pole vault swing-up rack of claim 4, further comprising a lower foam pad on the lower crossbar, wherein the lower foam pad comprises polyethylene foam.

9. The pole vault swing-up rack of claim 8, wherein the lower foam pad is surrounded by a rubber coating, the rubber coating comprising vinyl rubber tape.

10. The pole vault swing-up rack of claim 4, further comprising an upper foam pad on the upper crossbar, wherein the upper foam pad comprises polyethylene foam.

11. The pole vault swing-up rack of claim 10, further comprising a horizontal bar cut-out on the upper foam pad proximate to the pair of hooks on the back side of the frame body.

12. The pole vault swing-up rack of claim 10, wherein the upper foam pad is surrounded by a rubber coating, the rubber coating comprising vinyl rubber tape.

* * * * *